US009719202B2

(12) United States Patent
Jung et al.

(10) Patent No.: US 9,719,202 B2
(45) Date of Patent: Aug. 1, 2017

(54) BALANCER AND WASHING MACHINE HAVING THE SAME

(71) Applicant: SAMSUNG ELECTRONICS CO., LTD., Suwon-si, Gyeonggi-do (KR)

(72) Inventors: Dong Ha Jung, Seongnam-si (KR); Jeong Hoon Kang, Seoul (KR); Min Sung Kim, Yongin-si (KR); Doo Young Ryu, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 401 days.

(21) Appl. No.: 14/163,233

(22) Filed: Jan. 24, 2014

(65) Prior Publication Data

US 2014/0208805 A1 Jul. 31, 2014

(30) Foreign Application Priority Data

Jan. 25, 2013 (KR) ..... 10-2013-0008720

(51) Int. Cl.

*D06F 37/22* (2006.01)
*D06F 37/20* (2006.01)
*D06F 37/24* (2006.01)

(52) U.S. Cl.

CPC ..... *D06F 37/225* (2013.01); *D06F 37/20* (2013.01); *D06F 37/22* (2013.01); *D06F 37/24* (2013.01); *D06F 37/245* (2013.01); *D06F 37/203* (2013.01); *D06F 2222/00* (2013.01)

(58) Field of Classification Search

CPC ..... D06F 37/20; D06F 37/203; D06F 37/22; D06F 37/225; D06F 37/24; D06F 37/245; D06F 2222/00; F16F 15/363

See application file for complete search history.

(56) References Cited

U.S. PATENT DOCUMENTS 5,806,349 A * 9/1998 Kim ..... D06F 37/245 68/23.2
6,510,122 B1 * 1/2003 Yamauchi ..... G11B 17/028 369/266
2001/0038601 A1 * 11/2001 Kikuchi ..... F16F 15/363 720/701

(Continued)

FOREIGN PATENT DOCUMENTS

CN 1090695 C 9/2002
CN 102443999 A 5/2012

(Continued)

OTHER PUBLICATIONS

Machine translation of KR 10-2008-0037428, no date.*

(Continued)

*Primary Examiner* — Joseph L Perrin
(74) *Attorney, Agent, or Firm* — Staas & Halsey LLP

(57) ABSTRACT

A balancer includes a balancer housing having an annular channel defined therein, at least one mass movably disposed in the channel, at least one magnet coupled to one side of the balancer housing to restrain movement of the mass along the channel when rotational speed of a drum of the washing machine is within a predetermined range, and an inclined sidewall formed at an inner surface of the balancer housing to support the mass in a direction resisting centrifugal force applied to the mass during rotation of the drum.

9 Claims, 14 Drawing Sheets

(56) References Cited

U.S. PATENT DOCUMENTS

| | | | | |
|---|---|---|---|---|
| 2012/0084926 | A1 | 4/2012 | Lee et al. | |
| 2012/0192362 | A1 | 8/2012 | Lee et al. | |
| 2012/0278996 | A1 | 11/2012 | Park et al. | |
| 2013/0174690 | A1* | 7/2013 | Yoshinari | D06F 37/245 74/572.4 |

FOREIGN PATENT DOCUMENTS

| | | | |
|---|---|---|---|
| CN | 102767065 | A | 11/2012 |
| CN | 103911811 | A | 7/2014 |
| EP | 0 811 717 | | 12/1997 |
| EP | 2 441 872 | | 4/2012 |
| EP | 2 520 700 | | 11/2012 |
| EP | 2 752 516 | | 9/2014 |
| GB | 2 410 750 | | 8/2005 |
| KR | 10-0807256 | | 2/2008 |
| KR | 10-2008-0037428 | | 4/2008 |
| WO | WO 2012/089444 | | 7/2012 |
| WO | WO 2014/107004 | | 7/2014 |

OTHER PUBLICATIONS

European Search Report issued Jun. 16, 2014 in corresponding European Application No. 14152483.5.

International Search Report issued Apr. 14, 2014 in corresponding PCT Application No. PCT/KR2014/000612.

European Office Action issued Feb. 17, 2016 in corresponding European Patent Application No. 14 152 483.5.

Australian Office Action issued Mar. 22, 2016 in corresponding Australian Patent Application No. 2014210521.

European Office Action dated Oct. 7, 2016 from European Patent Application No. 14 152 483.5, 4 pages.

Australian Office Action dated Aug. 4, 2016 from Australian Patent Application No. 2014210521, 3 pages.

Australian Notice of Acceptance dated Sep. 19, 2016 from Australian Patent Application No. 2014210521, 2 pages.

Russian Office Action dated Oct. 19, 2016 from Russian Patent Application No. 2015131011/12(047719).

Chinese Office Action dated Nov. 28, 2016 from Chinese Patent Application No. 201410037839.2, 23 pages.

Russian Office Action dated Mar. 15, 2017 from Russian Patent Application No. 2015131011/12(047719), 11 pages.

* cited by examiner

BALANCER AND WASHING MACHINE HAVING THE SAME

CROSS-REFERENCE TO RELATED APPLICATIONS

This application claims the benefit of Korean Patent Application No. 10-2013-0008720, filed on Jan. 25, 2013 in the Korean Intellectual Property Office, the disclosure of which is incorporated herein by reference.

BACKGROUND

1. Field

Embodiments of the present disclosure relate to a washing machine having a balancer to offset unbalanced load generated during rotation of a drum.

2. Description of the Related Art

A washing machine is a machine that washes clothes using electric power. Generally, the washing machine includes a cabinet forming the external appearance of the washing machine, a tub to contain wash water in the cabinet, a drum rotatably installed in the tub, and a motor to rotate the drum.

When the drum is rotated by the motor in a state in which laundry is put in the drum together with detergent water, contaminants are removed from the laundry by friction between the laundry and the drum and between the laundry and wash water.

If the laundry is not uniformly distributed in the drum but accumulates at one side during rotation of the drum, vibration and noise are generated due to eccentric rotation of the drum. According to circumstances, parts, such as the drum or the motor, of the washing machine may be damaged.

For this reason, the washing machine has a balancer that offsets unbalanced load generated in the drum to stabilize rotation of the drum.

SUMMARY

It is an aspect of the present disclosure to provide a balancer with improved performance and a washing machine having the same.

Additional aspects of the disclosure will be set forth in part in the description which follows and, in part, will be apparent from the description, or may be learned by practice of the disclosure.

In accordance with one aspect of the present disclosure, a balancer, mounted to a drum of a washing machine to offset unbalanced load generated in the drum during rotation of the drum, includes a balancer housing having an annular channel defined therein, at least one mass movably disposed in the channel, at least one magnet coupled to one side of the balancer housing to restrain movement of the mass along the channel when rotational speed of the drum is within a predetermined range, and an inclined sidewall formed at an inner surface of the balancer housing to support the mass in a direction resisting centrifugal force applied to the mass during rotation of the drum.

The inclined sidewall may extend along the inner surface of the balancer housing in a circumferential direction of the balancer housing.

The inclined sidewall may have an inclination angle changed in the circumferential direction of the balancer housing.

The inclination angle of the inclined sidewall may be increased and then decreased in the circumferential direction of the balancer housing.

The inclined sidewall may have an inclination angle of 5 to 25 degrees.

The balancer housing may include a first housing opened at one side thereof and a second housing to cover the first housing to define the annular channel and the inclined sidewall may be formed at the first housing.

The first housing may include a first inner surface corresponding to an inner circumference of the first housing and a second inner surface corresponding to an outer circumference of the first housing, the second inner surface being opposite to the first inner surface, and the inclined sidewall may be formed at the second inner surface.

The magnet may be coupled to an outer surface of the balancer housing and disposed at a position corresponding to the inclined sidewall.

The magnet may include a pair of magnets disposed symmetrically on the basis of a virtual line passing through a center of rotation of the drum.

The balancer may include at least one groove formed at the first inner surface to receive the mass such that movement of the mass along the channel is restrained when rotational speed of the drum is within a predetermined range, wherein the groove may be disposed at a position corresponding to the inclined sidewall.

A fluid to prevent abrupt movement of the mass may be contained in the channel.

In accordance with another aspect of the present disclosure, a washing machine includes a cabinet, a drum rotatably disposed in the cabinet, and a balancer coupled to the drum to offset unbalanced load generated in the drum during rotation of the drum, wherein the balancer includes a balancer housing having an annular channel defined therein, at least one mass movably disposed in the channel, and a first magnet and a second magnet coupled to one side of the balancer housing to restrain movement of the mass along the channel when rotational speed of the drum is within a predetermined range and wherein an angle between a first perpendicular line perpendicularly connecting the first magnet and a center of rotation of the drum and a second perpendicular line perpendicularly connecting the second magnet and the center of rotation of the drum is between 150 and 210 degrees.

The first magnet and the second magnet may be disposed symmetrically.

The first magnet and the second magnet may be coupled to a rear surface of the balancer housing.

The washing machine may include an inclined sidewall formed at an inner surface of the balancer housing to support the mass in a direction resisting centrifugal force applied to the mass during rotation of the drum, wherein the magnet may be disposed at a position corresponding to the inclined sidewall.

The inclined sidewall may include first sections and a second section having different inclination angles.

The second section may be disposed between the first sections and the inclination angle of the second section may be greater than the inclination angle of the first sections.

The inclined sidewall may have an inclination angle successively changed in a circumferential direction of the balancer housing.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
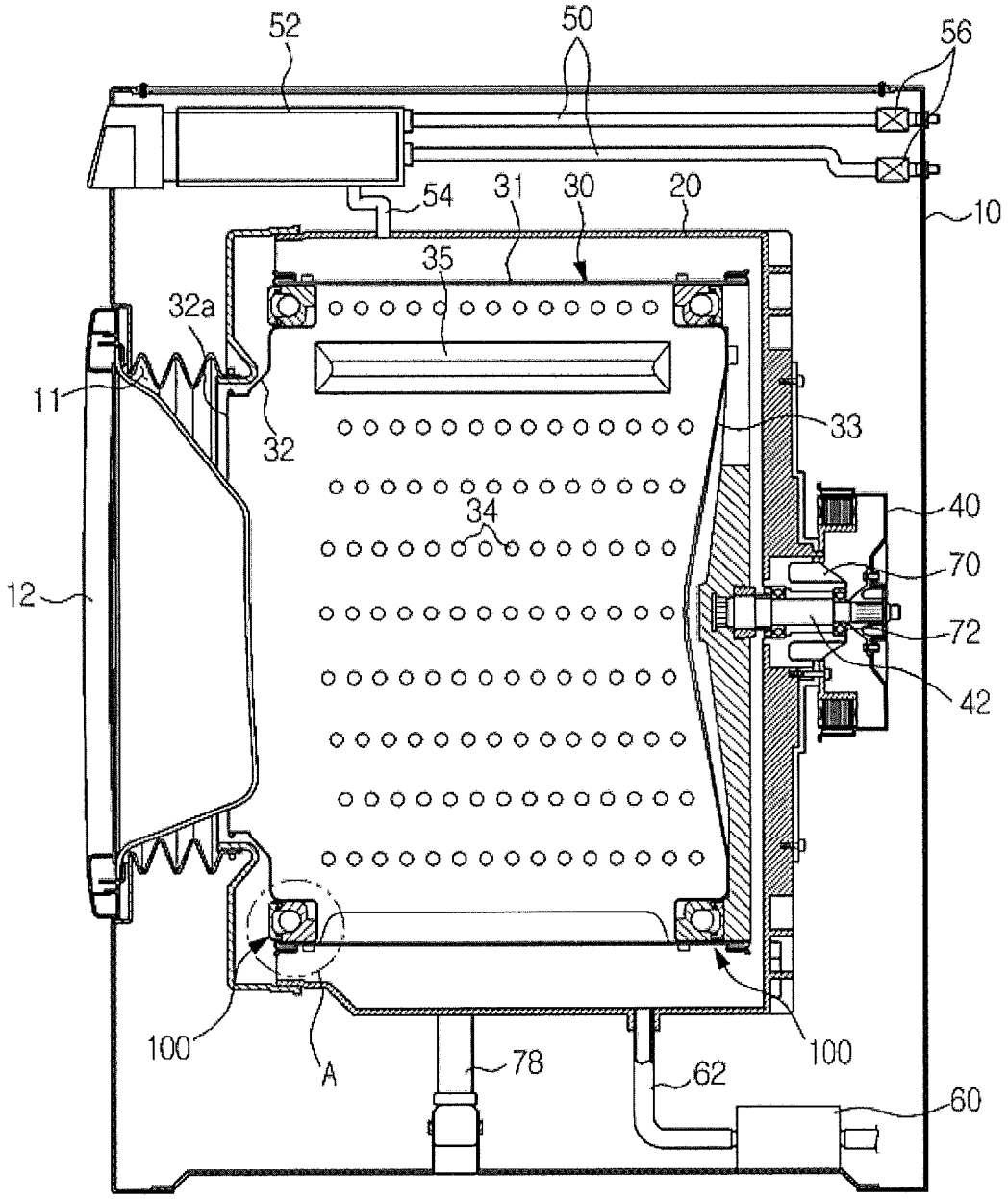
FIG. 1 is a view showing the construction of a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a view showing the construction of a washing machine according to an embodiment of the present disclosure.

As shown in FIG. 1, a washing machine 1 includes a cabinet 10 forming the external appearance thereof, a tub 20 disposed in the cabinet 10, a drum 30 rotatably disposed in the tub 20, and a motor 40 to drive the drum 30.

An introduction port 11, through which laundry is introduced into the drum 30, is formed at the front of the cabinet 10. The introduction port 11 is opened and closed by a door 12 installed at the front part of the cabinet 10.

Above the tub 20 is installed a water supply pipe 50 to supply wash water to the tub 20. One side of the water supply pipe 50 is connected to a water supply valve 56 and the other side of the water supply pipe 50 is connected to a detergent supply unit 52.

The detergent supply unit 52 is connected to the tub 20 via a connection pipe 54. Water, supplied through the water supply pipe 50, is supplied into the tub 20 together with detergent via the detergent supply unit 52.

Under the tub 20 are provided a drainage pump 60 and a drainage pipe 62 to discharge water in the tub 20 from the cabinet 10.

The drum 30 includes a cylinder part 31, a front plate 32 disposed at the front of the cylinder part 31, and a rear plate 33 disposed at the rear of the cylinder part 31. An opening 32*a*, through which laundry is introduced and removed, is formed at the front plate 32. A drive shaft 42 to transmit power from the motor 40 to the drum 30 is connected to the rear plate 33.

The drum 30 is provided at the circumference thereof with a plurality of through holes 34, through which wash water flows. The drum 30 is provided at the inner circumference thereof with a plurality of lifters 35, by which laundry is raised and dropped when the drum 30 is rotated.

The drive shaft 42 is disposed between the drum 30 and the motor 40. One end of the drive shaft 42 is connected to the rear plate 33 of the drum 30 and the other end of the drive shaft 42 extends to the outside of the rear wall of the tub 20. When the drive shaft 42 is driven by the motor 40, the drum 30 connected to the drive shaft 42 is rotated about the drive shaft 42.

At the rear wall of the tub 20 is installed a bearing housing 70 to rotatably support the drive shaft 42. The bearing housing 70 may be made of an aluminum alloy. The bearing housing 70 may be inserted into the rear wall of the tub 20 when the tub 20 is injection molded. Between the bearing housing 70 and the drive shaft 42 are installed bearings 72 to smoothly rotate the drive shaft 42.

The tub 20 is supported by a damper 78. The damper 78 is connected between the inside bottom of the cabinet 10 and the outer surface of the tub 20.

During a washing cycle, the motor 40 rotates the drum 30 in alternating directions at low speed. As a result, laundry in the drum 30 is repeatedly raised and dropped so that contaminants are removed from the laundry.

During a spin-drying cycle, the motor 40 rotates the drum 30 in one direction at high speed. As a result, water is separated from laundry by centrifugal force applied to the laundry.

If the laundry is not uniformly distributed in the drum 30 but accumulates at one side when the drum 30 is rotated during spin-drying, rotation of the drum 30 is unstable, generating vibration and noise.

For this reason, the washing machine 1 includes a balancer 100 to stabilize rotation of the drum 30.

Figure 2:
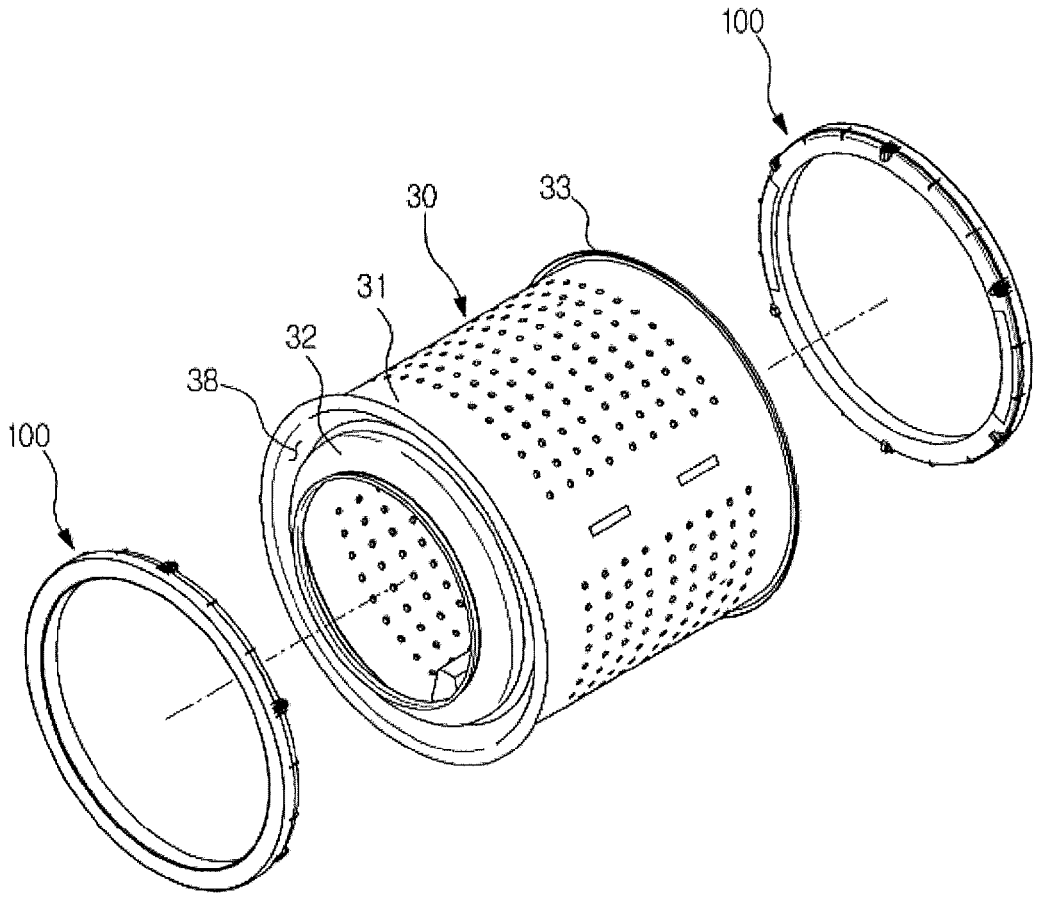
FIG. 2 is an exploded perspective view showing a drum and a balancer according to an embodiment of the present disclosure.
Figure 3:
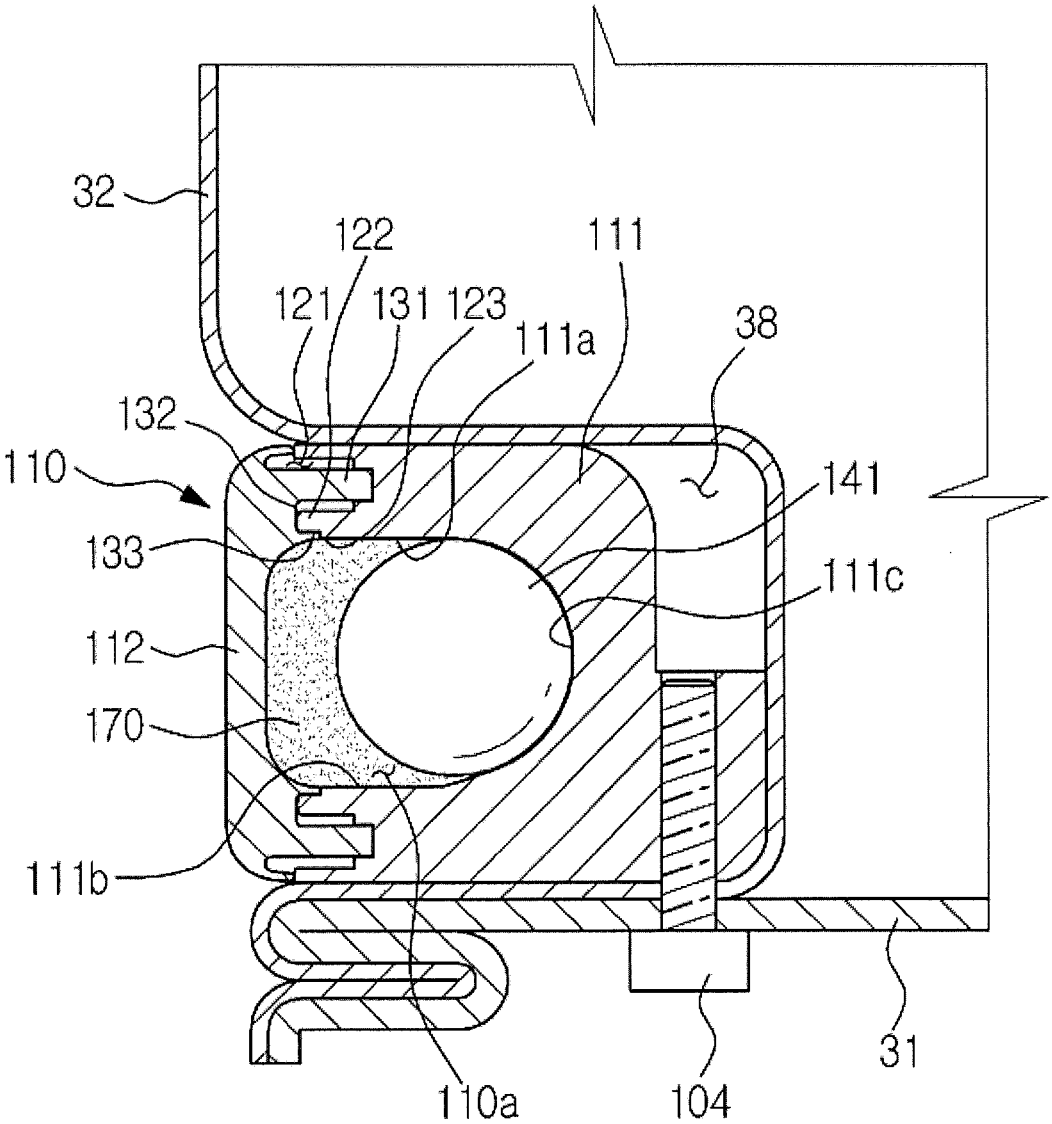
FIG. 3 is an enlarged view showing part A of FIG. 1.
Figure 4:
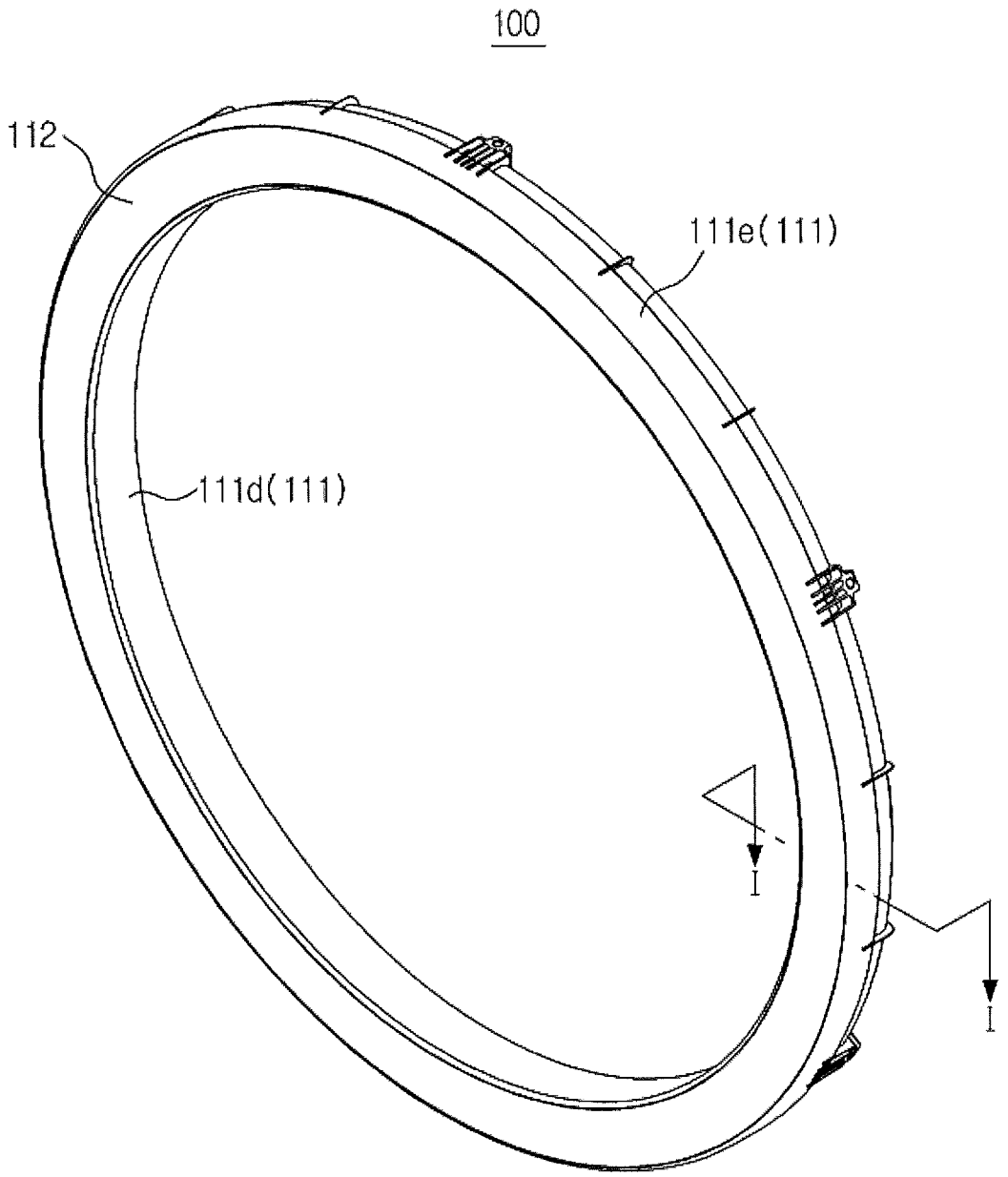
FIG. 4 is a perspective view showing the balancer according to the embodiment of the present disclosure.
Figure 5:
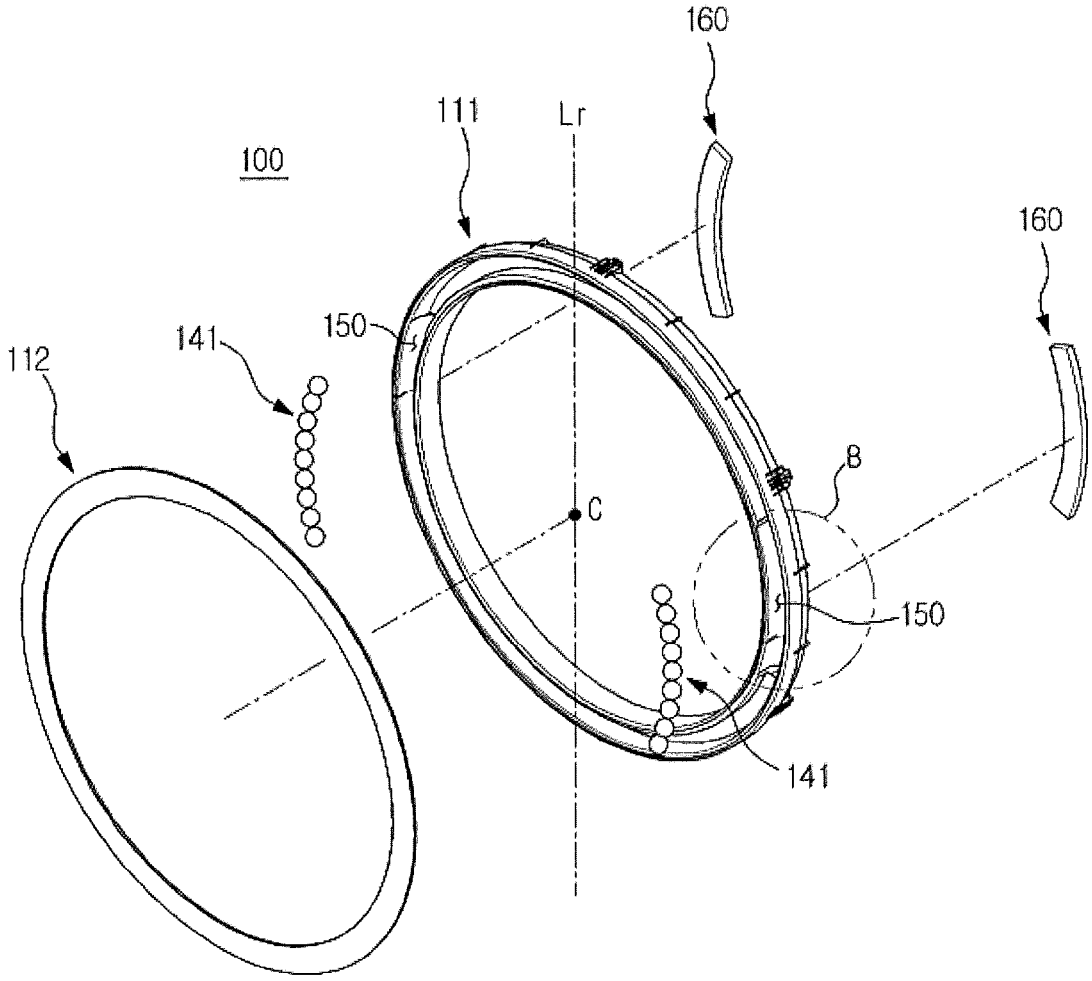
FIG. 5 is an exploded perspective view of the balancer shown in FIG. 4.
Figure 6:
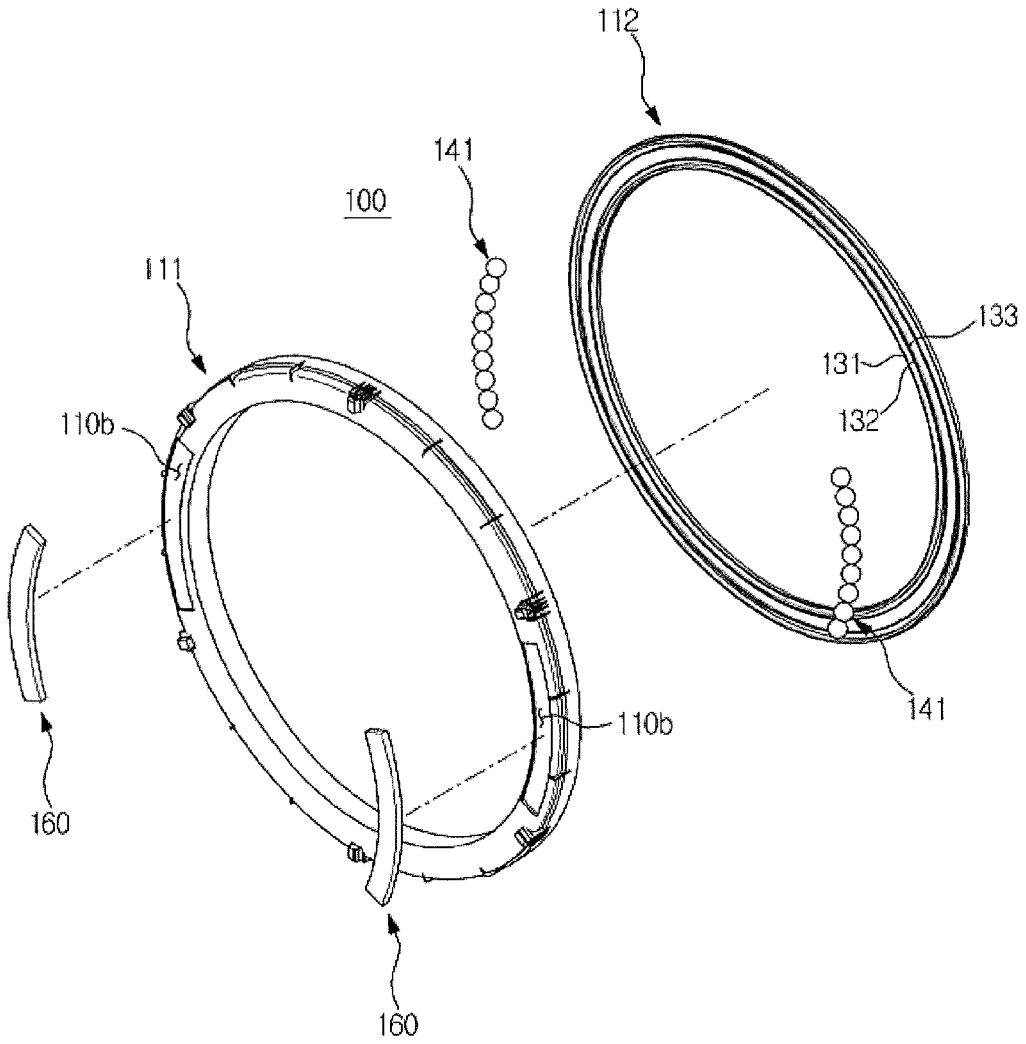
FIG. 6 is an exploded perspective view of FIG. 5 when viewed from another angle.
Figure 7:
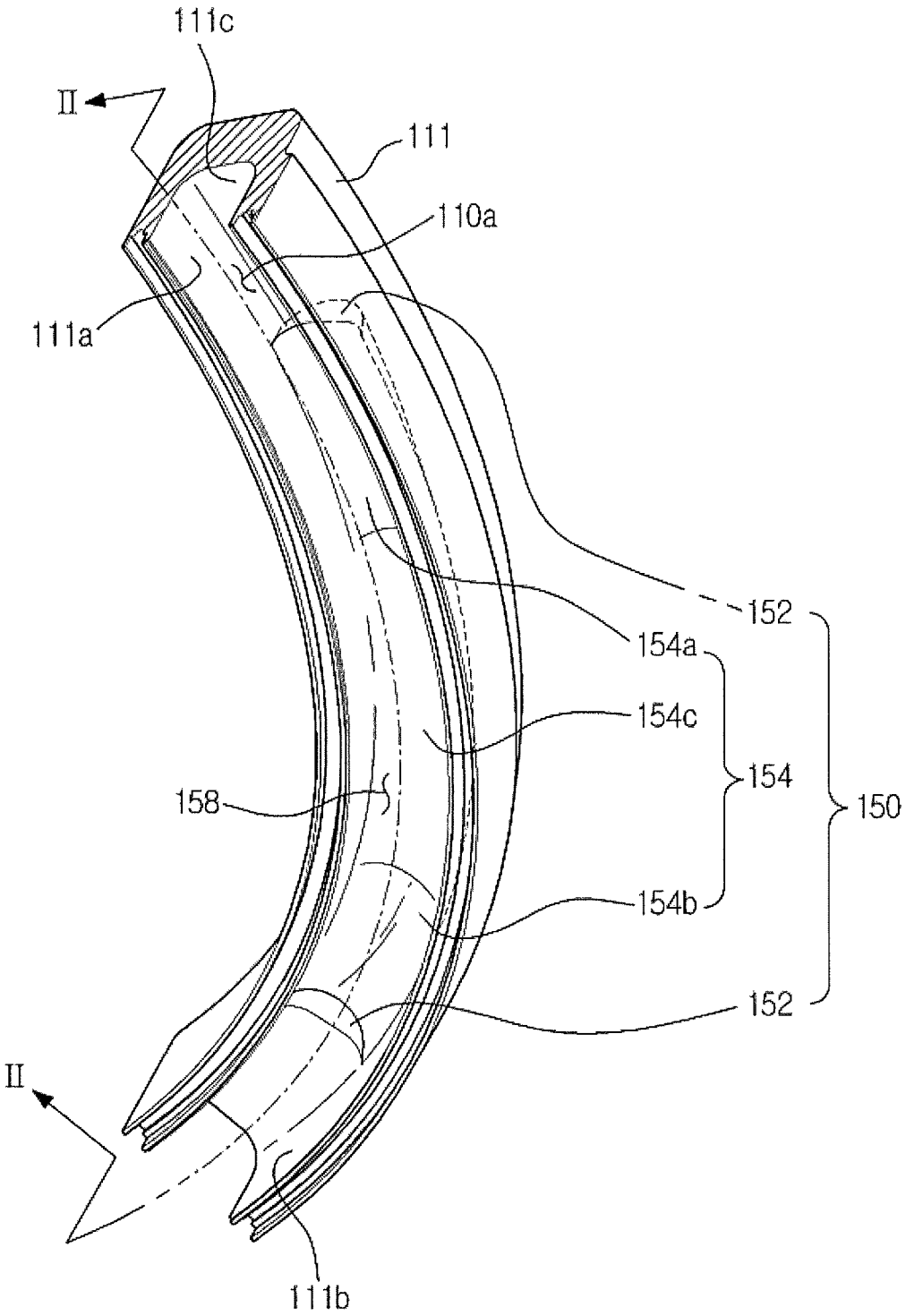
FIG. 7 is an enlarged view showing part B of FIG. 5.
Figure 8:
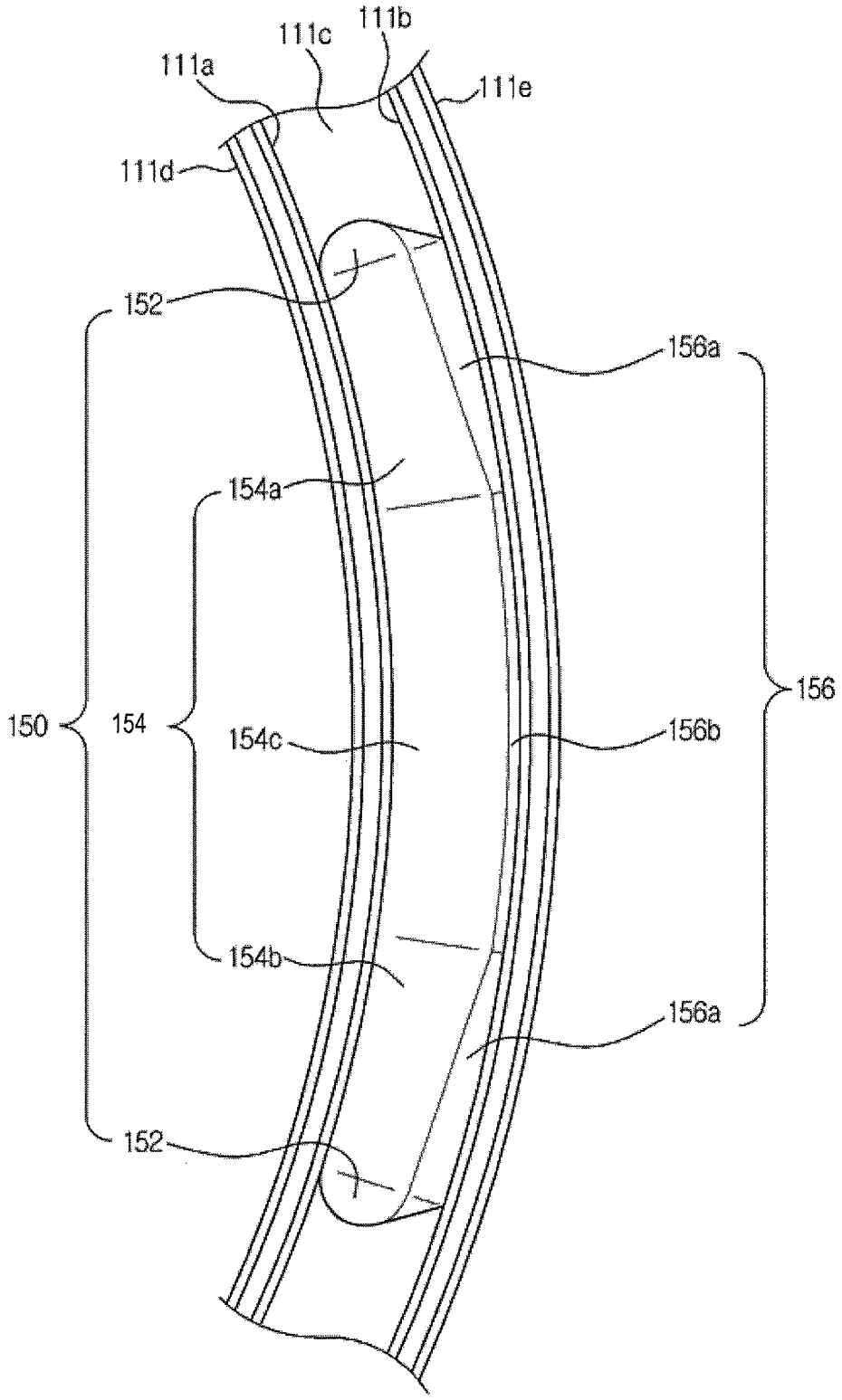
FIG. 8 is a front view of FIG. 7.
Figure 9:
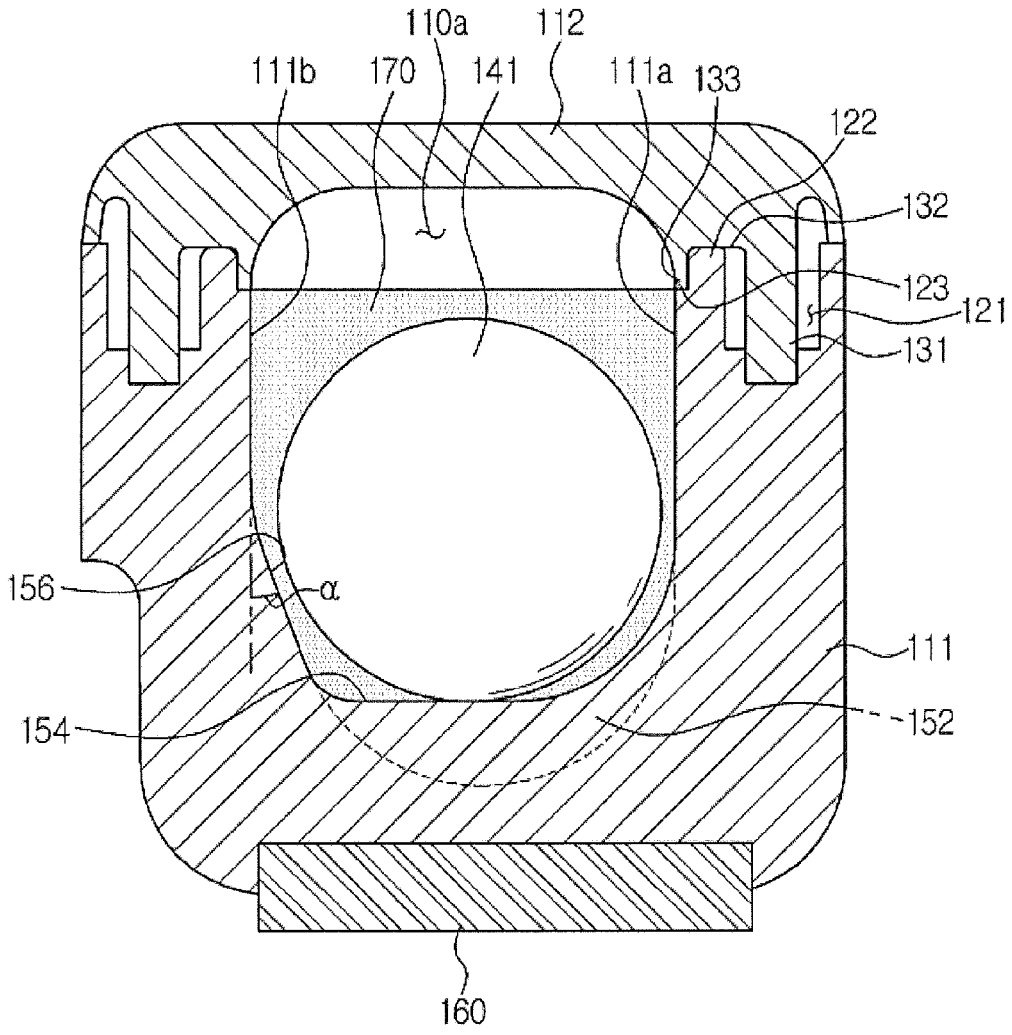
FIG. 9 is a sectional view taken along line I-I of FIG. 4.
Figure 10:
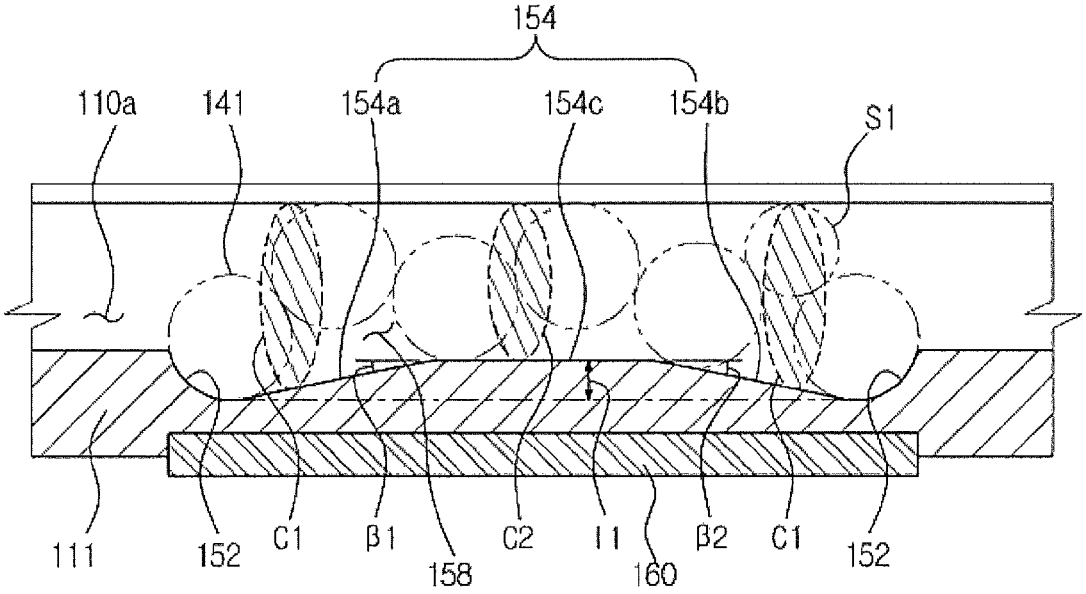
FIG. 10 is a sectional view taken along line II-II of FIG. 7.
Figure 11:
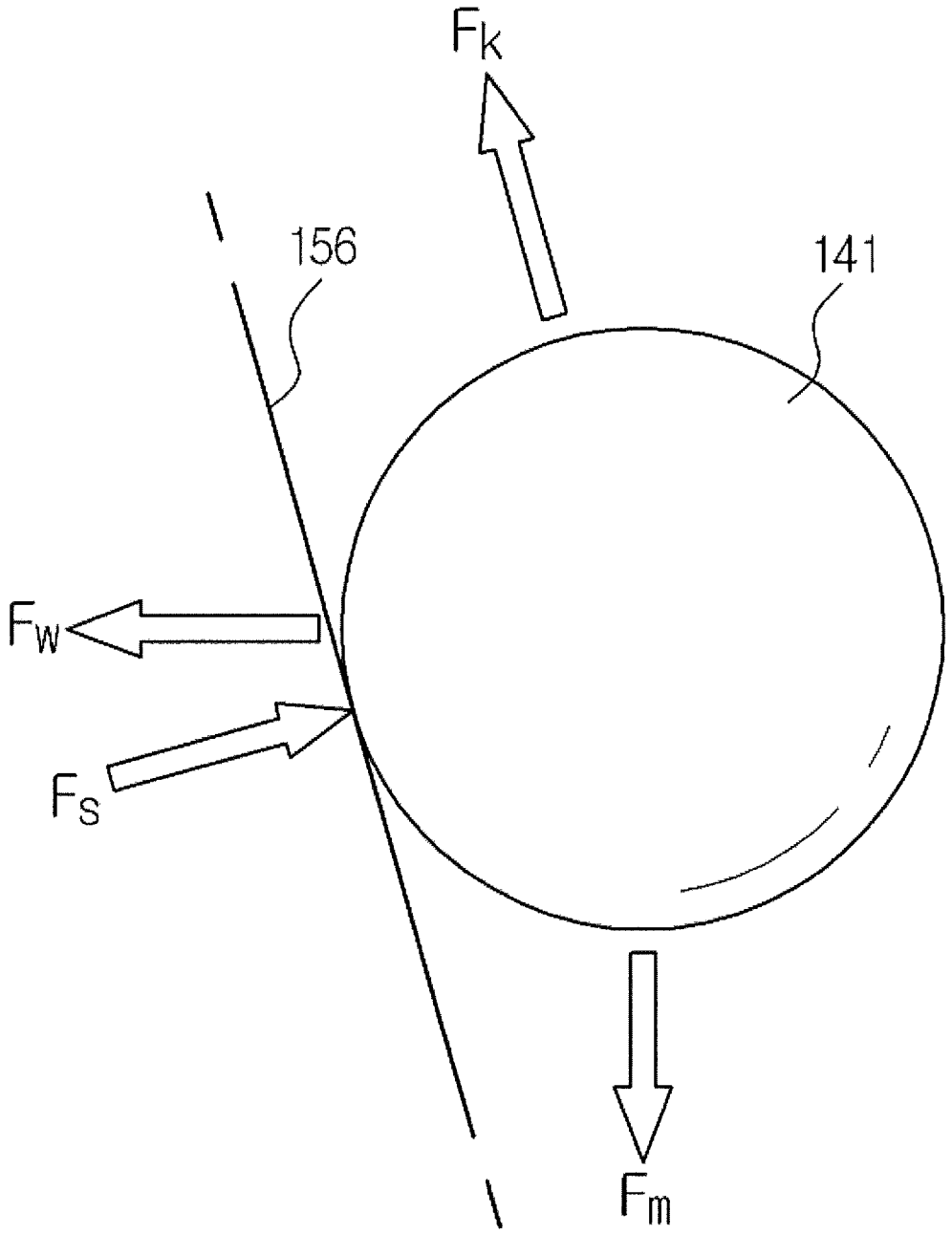
FIG. 11 is a view illustrating a relationship among centrifugal force, magnetic force, and supporting force generated by an inclined sidewall.

FIG. 2 is an exploded perspective view showing a drum and a balancer according to an embodiment of the present disclosure and FIG. 3 is an enlarged view showing part A of FIG. 1. FIG. 4 is a perspective view showing the balancer according to the embodiment of the present disclosure, FIG. 5 is an exploded perspective view of the balancer shown in FIG. 4, and FIG. 6 is an exploded perspective view of FIG. 5 when viewed from another angle. FIG. 7 is an enlarged view showing part B of FIG. 5 and FIG. 8 is a front view of FIG. 7. FIG. 9 is a sectional view taken along line I-I of FIG. 4 and FIG. 10 is a sectional view taken along line II-II of FIG. 7. FIG. 11 is a view illustrating a relationship among centrifugal force, magnetic force, and supporting force generated by an inclined sidewall.

The balancer 100 may be mounted to the front plate 32 and/or the rear plate 33 of the drum 30. The balancer 100 mounted to the front plate 32 and the balancer 100 mounted to the rear plate 33 are the same. Hereinafter, therefore, a description will be given of the balancer 100 mounted to the front plate 32.

As shown in FIGS. 1 to 10, the balancer 100 includes a balancer housing 110 having an annular channel 110*a* and a plurality of masses 141 disposed in the annular channel 110*a* such that the masses 141 move along the annular channel 110*a* to perform a balancing function of the drum 30.

An annular recess 38, which is open at the front thereof, is formed at the front plate 32 of the drum 30. The balancer housing 110 is received in the recess 38. The balancer housing 110 may be coupled to the drum 30 by fixing members 104 such that the balancer housing 110 is securely fixed to the drum 30.

The balancer housing 110 includes a first annular housing 111 opened at one side thereof and a second housing 112 to cover the opening of the first housing 111. The inner surface of the first housing 111 and the inner surface of the second housing 112 define the annular channel 110*a*. The first housing 111 and the second housing 112 may be manufactured by injection molding of plastic, such as polypropylene (PP) or acrylonitrile butadiene styrene (ABS). In addition, the first housing 111 and the second housing 112 may be thermally welded to each other. In the following, the front surface of the balancer housing 110 is defined as a surface exposed forward when the balancer housing 110 is coupled to the drum 30 and the rear surface of the balancer housing 110, which is opposite to the front surface of the balancer housing 110, is defined as a surface facing the front plate 32 of the drum 30 when the balancer housing 110 is coupled to the drum 30. In addition, the side surface of the balancer housing 110 is defined as a surface connected between the front surface and the rear surface of the balancer housing 110.

The first housing 111 has first coupling grooves 121 formed at opposite sides of the channel 110*a* and the second housing 112 has first coupling protrusions 131 coupled in the first coupling grooves 121. Second coupling protrusions 122 are formed between the first coupling grooves 121 of the first housing 111 and the channel 110*a*. The second coupling protrusions 122 of the first housing 111 are coupled in second coupling grooves 132 formed at the insides of the first coupling protrusions 131 of the second housing 112. Third coupling grooves 123 are formed at the insides of the second coupling protrusions 122 adjacent to the channel 110*a* and the second housing 112 has third coupling protrusions 133 coupled in the third coupling grooves 123. In the above coupling structure, the first housing 111 and the second housing 112 may be securely coupled to each other and, in a case in which a fluid, such as oil, is contained in the channel 110*a*, leakage of the fluid may be prevented.

The first housing 111 includes a first inner surface 111*a* and a second inner surface 111*b*, which are opposite to each other and a third inner surface 111*c* connected between the first inner surface 111*a* and the second inner surface 111*b*. The first inner surface 111*a* corresponds to an inner circumference 111*d* of the first housing 111 and the second inner surface 111*b* corresponds to an outer circumference 111*e* of the first housing 111.

At least one selected from among the first inner surface 111*a*, the second inner surface 111*b*, and the third inner surface 111*c* is provided with a groove 150, in which the masses 141 are located such that the masses 141 are temporarily restrained. In FIGS. 7 and 8, the groove 150 is formed in the first inner surface 111*a* and the third inner surface 111*c*. However, embodiments of the present disclosure are not limited thereto. For example, the groove 150 may be formed in any one selected from among the first inner surface 111*a*, the second inner surface 111*b*, and the third inner surface 111*c*, in the first inner surface 111*a* and the third inner surface 111*c*, or in the first inner surface 111*a*, the second inner surface 111*b*, and the third inner surface 111*c*.

In order to prevent unbalanced load from being generated in the drum 30 due to the masses 141 in a state in which the masses 141 are located in each groove 150, grooves 150 may be disposed symmetrically on the basis of a virtual line Lr passing through a center of rotation of the drum 30 and perpendicular to the ground.

The groove 150 extends in a circumferential direction of the balancer housing 110 to receive at least two masses 141. The groove 150 includes first support parts 152 to support the masses 141 approximately in the circumferential direction and a radial direction of the balancer housing 110, a second support part 154 provided between the first support parts 152 to support the masses 141 approximately in the radial direction of the balancer housing 110, inclined surfaces 154*a* and 154*b* inclined inwardly of the channel 110*a* of the balancer housing 110, and at least one flat surface 154*c* provided between the inclined surfaces 154*a* and 154*b*.

The first support parts 152 are provided at the opposite ends of the groove 150 in the form of a step projection to prevent the masses 141 from being separated from the groove 150 when the number of rotations of the drum 30 is within a predetermined range.

The second support part 154 protrudes inwardly of the channel 110*a*. The inclined surfaces 154*a* and 154*b* and the flat surface 154*c* are provided at the second support part 154. The inclined surfaces 154*a* and 154*b* include a first inclined surface 154*a* and a second inclined surface 154*b* disposed in a state in which the flat surface 154*c* is located between the first inclined surface 154*a* and the second inclined surface 154*b*. Opposite ends of the first inclined surface 154*a* and the second inclined surface 154*b* are connected to the first support parts 152 and the flat surface 154*c*. A first inclination angle β1 between the flat surface 154*c* and the first inclined surface 154*a* may be different from a second inclination angle β2 between the flat surface 154*c* and the second inclined surface 154*b*. A length l1 of the second support part 154 protruding inwardly of the channel may be between 1 mm and 3 mm.

The channel 110*a* includes a section increase portion 158 formed at a region thereof where the groove 150 is formed. The section increase portion 158 is a space defined in the channel 110*a* by the groove 150. The section increase portion 158 is formed in a shape corresponding to at least a portion of the mass 141. In the same manner as in the groove 150, each section increase portion 158 may extend in the circumferential direction of the balancer housing 110 to receive at least two masses 141 and section increase portions 158 may be disposed symmetrically on the basis of a virtual line Lr passing through a center of rotation of the drum 30.

A sectional area C1 at each end of the section increase portion 158 is greater than a sectional area C2 between opposite ends of the section increase portion 158 due to the first inclined surface 154*a*, the second inclined surface 154*b*, and the flat surface 154*c* provided at the second support part 154.

Since the second support part 154 is formed in a shape protruding inwardly of the channel 110*a*, a free space is generated between the masses 141 received in the groove 150 or the section increase portion 158. When the number of rotations per minute of the drum 30 deviates from a predetermined range, therefore, the masses 141 are smoothly separated from the groove 150 without sticking to the groove 150. As a result, the masses 141 move along the channel 110*a* to perform a balancing function of the drum 30.

The balancer housing 110 is provided at the rear surface thereof corresponding to the inner surface of the balancer housing 110, at which the groove 150 is formed, with a magnet receiving groove 110*b* to receive a magnet such that the magnet is coupled to the magnet receiving groove 110*b*. The magnet receiving groove 110*b* may be formed in a shape corresponding to the magnet 160 such that the magnet is coupled to the magnet receiving groove 110*b*.

The magnet 160 is formed in an arc shape and is coupled to the rear surface of the balancer housing 110 to restrain at least one mass 141 received in the groove 150 such that the mass 141 is not separated from the groove 150. The magnet 160 may be fixed in the magnet receiving groove 110*b* by force fitting or using an additional coupling material.

The magnet 160 is not necessarily coupled to the rear surface of the balancer housing 110. The magnet 160 may be coupled to the front surface of the balancer housing 110 or to the side surface of the balancer housing 110 connected between the front surface and the rear surface of the balancer housing 110.

The magnet 160 restrains the mass 141 using magnetic force. Intensity of the magnetic force generated by the magnet 160 is decided based on the number of rotations per minute of the drum 30 when the mass 141 is separated from the groove 150. For example, in order to set the number of rotations per minute of the drum 30 when the mass 141 is separated from the groove 150 to 200 rpm, intensity of the magnetic force generated by the magnet 160 may be adjusted to restrain the mass 141 such that at least one mass 141 received in the groove 150 is not separated from the groove 150 in a case in which the number of rotations per minute of the drum 30 is between 0 and 200 rpm and such that the mass 141 is separated from the groove 150 in a case in which the number of rotations per minute of the drum 30 exceeds 200 rpm. Intensity of the magnetic force generated by the magnet 160 may be adjusted to a desired value based on the size of the magnet 160, the number of the magnets 160, the material of the magnet 160, and a magnetization mode of the magnet 160.

An inclined sidewall 156 is provided at the second inner surface 111*b* corresponding to the first inner surface 111*a* in which the groove 150 is formed. As shown in FIG. 11, the inclined sidewall 156 generates supporting force Fs to support the mass 141 in a direction resisting centrifugal force Fw applied to the mass 141 during rotation of the drum 30.

The centrifugal force Fw applied to the mass 141 during rotation of the drum 30 is offset by the supporting force Fs of the inclined sidewall 156 applied to the mass 141. Consequently, magnetic force Fm generated by the magnet 160 coupled to the rear surface of the balancer housing 110 offsets the remainder of the centrifugal force Fw applied to the mass 141 after offset by the supporting force Fs of the inclined sidewall 156 applied to the mass 141, i.e. only force Fk formed along the inclined sidewall 156. When the number of rotations of the drum 30 is within a predetermined range, therefore, the movement of the mass 141 may be restrained.

As described above, the inclined sidewall 156 is provided at the second inner surface 111*b* corresponding to the first inner surface 111*a* in which the groove 150 is formed such that the centrifugal force Fw applied to the mass 141 during rotation of the drum 30 is offset by the inclined sidewall 156. Consequently, the movement of the mass 141 is effectively restrained and controlled even using magnetic force Fm having low intensity.

The inclined sidewall 156 may have an inclination angle α of about 5 to 25 degrees. The inclination angle α of the inclined sidewall 156 may be changed in the circumferential direction of the second inner surface 111*b*. As shown in FIG. 8, the inclined sidewall 156 includes first sections 156*a* and a second section 156*b* having different inclination angles. The second section 156*b* is disposed between the first sections 156*a*. At the first sections 156*a* of the inclined sidewall 156, the inclination angle α of the inclined sidewall 156 may be maintained at 5 degrees. At the second section 156*b* of the inclined sidewall 156, the inclination angle α of the inclined sidewall 156 may be maintained at an angle greater than 5 degrees or less than 25 degrees.

In addition, the inclination angle α of the inclined sidewall 156 may be successively increased or decreased in the circumferential direction of the second inner surface 111*b*.

Each mass 141 is formed of a metal material having a spherical shape. The masses 141 are movably disposed along the annular channel 110*a* in the circumferential direction of the drum 30 to offset unbalanced load in the drum 30 during rotation of the drum 30. When the drum 30 is rotated, centrifugal force is applied to the masses 141 in a direction in which the radius of the drum 30 is increased and the masses 141, separated from the groove 150, move along the channel 110*a* to perform a balancing function of the drum 30.

The masses 141 are received in the first housing 111 before the first housing 111 and the second housing 112 are welded to each other. The masses 141 may be disposed in the balancer housing 110 by welding the first housing 111 and the second housing 112 to each other in a state in which the masses 141 are received in the first housing 111.

A damping fluid 170 to prevent abrupt movement of the masses 141 is contained in the balancer housing 110.

The damping fluid 170 applies resistance to the masses 141 when force is applied to the masses 141 to prevent the masses 141 from abruptly moving in the channel 110*a*. The damping fluid 170 may be oil. The damping fluid 170 partially performs a balancing function of the drum 30 together with the masses 141 during rotation of the drum 30.

The damping fluid 170 is injected into the first housing 111 together with the masses 141 and is received in the balancer housing 110 by welding the first housing 111 and the second housing 112 to each other. However, embodiments of the present disclosure are not limited thereto. For example, the first housing 111 and the second housing 112 may be welded to each other and then the damping fluid 170 may be injected into the balancer housing 110 through an injection port (not shown) formed at the first housing 111 or the second housing 112 such that the damping fluid 170 is received in the balancer housing 110.

Figure 12:
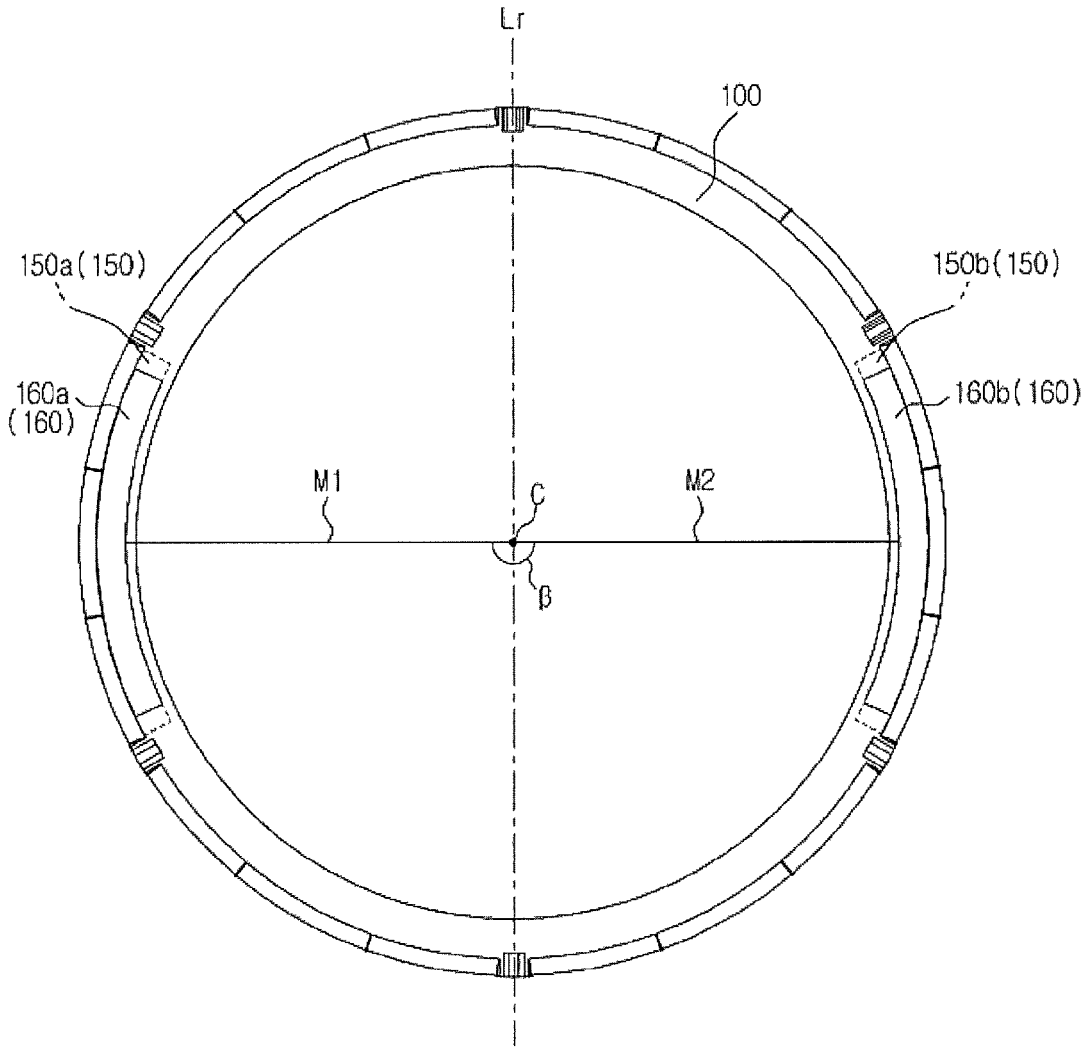
FIG. 12 is a view showing a structure in which magnets are disposed on the balancer housing.

FIG. 12 is a view showing a structure in which magnets are disposed on the balancer housing. Specifically, FIG. 12 is a view of the balancer housing when viewed from the rear of the balancer housing.

As shown in FIG. 12, the magnets 160 include a pair of first and second magnets 160*a* and 160*b* disposed at positions corresponding to the grooves 150 and coupled to the rear surface of the balancer housing 110.

The first magnet 160*a* and the second magnet 160*b* may be disposed such that an angle β between a first perpendicular line M1 perpendicularly connecting the first magnet 160*a* and a center of rotation C of the drum 30 and a second perpendicular line M2 perpendicularly connecting the second magnet 160*b* and the center of rotation C of the drum 30 is between 150 and 210 degrees. Alternatively, the first magnet 160*a* and the second magnet 160*b* may be disposed such that the angle β between the first perpendicular line M1 and the second perpendicular line M2 is 180 degrees. In a case in which the angle β between the first perpendicular line M1 and the second perpendicular line M2 is 180 degrees, the first magnet 160*a* and the second magnet 160*b* are disposed symmetrically on the basis of a virtual line Lr passing through the center of rotation C of the drum 30 and perpendicular to the ground.

It is assumed that the number of rotations per minute of the drum 30 does not exceed 200 rpm and thus the masses 141 may be restrained by the magnets 160 as described above. In a case in which the number of magnets 160 is three or more, if the masses 141 are restrained between two neighboring magnets 160, the masses 141 may not move to the remaining magnets 160. Consequently, the masses 141 may not be uniformly distributed in the balancer housing 110 with the result that unbalanced load may be generated in the drum 30.

In a case in which a pair of magnets 160 is disposed symmetrically on the basis of the virtual line Lr passing through the center of rotation of the drum 30, if corresponding masses 141 are received in one groove 150*a*, the remaining masses 141 may be naturally received in the other groove 150*b* during rotation of the drum 30 and then restrained by the magnets 160. Consequently, nonuniform distribution of the masses 141 in the balancer housing 110 is prevented.

Hereinafter, a principle in which the masses 141 are restrained by the grooves 150 and the magnets 160 when the number of rotations per minute of the drum 30 is within a predetermined range and the masses 141 are separated from the grooves 150 when the number of rotations per minute of the drum 30 deviates from the predetermined range to balance the drum 30 will be described.

Figure 13:
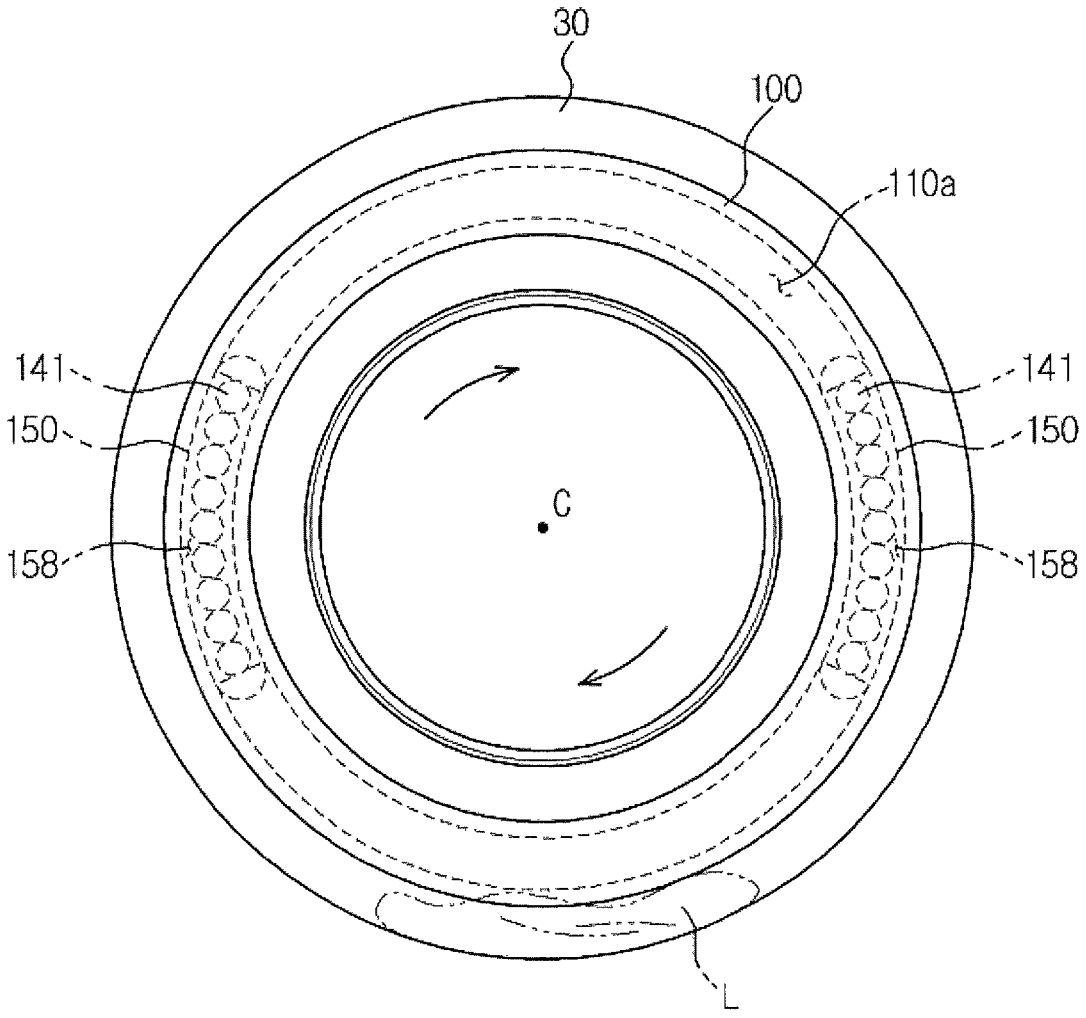
FIGS. 13 and 14 are views showing an operating principle of the balancer according to the embodiment of the present disclosure.
Figure 14:
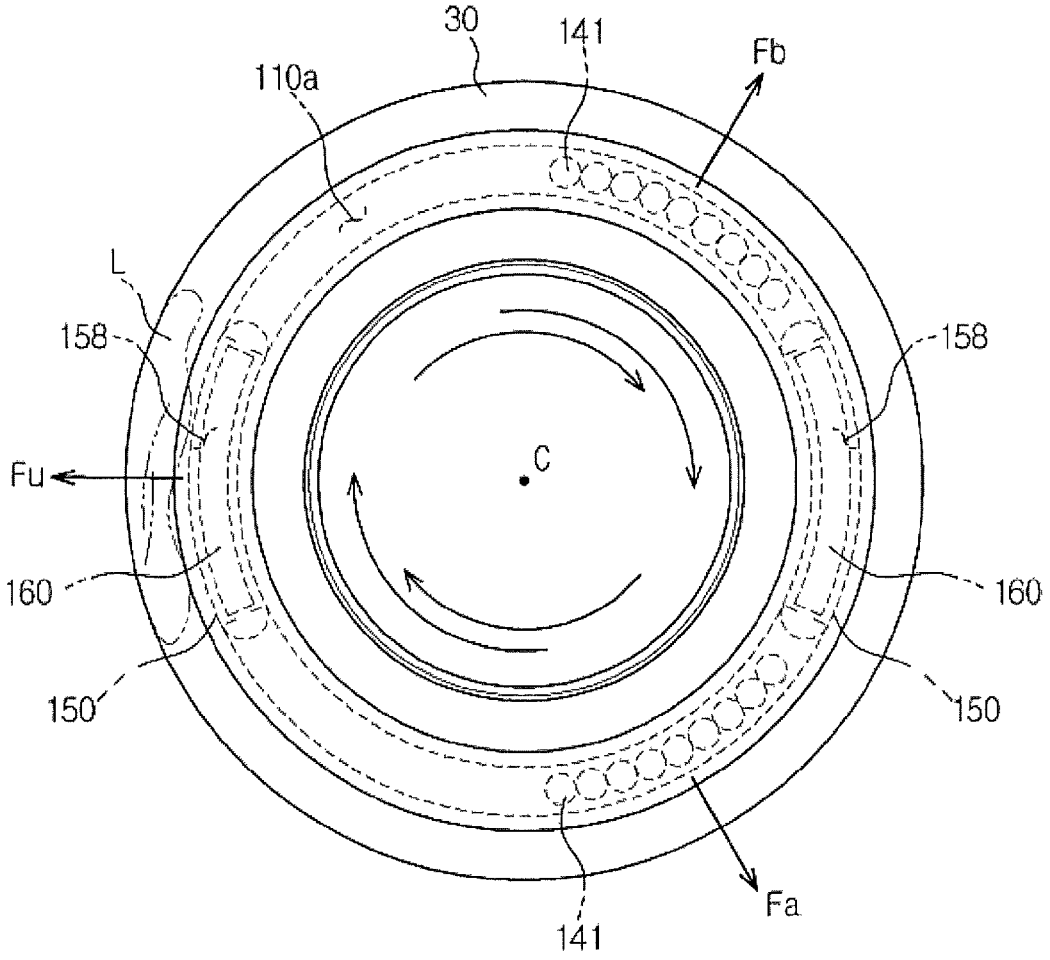

FIGS. 13 and 14 are views showing an operating principle of the balancer according to the embodiment of the present disclosure. A damping fluid 170 is omitted from FIGS. 13 and 14.

As shown in FIG. 13, when the number of rotations per minute of the drum 30 is within a predetermined range at the beginning of spin-drying of laundry, the masses 141 are received in the grooves 150 or the section increase portions 158 and movement of the masses 141 is restrained by the magnets 160.

Before spin-drying is commenced, i.e. before the drum 30 is rotated, the masses 141 are disposed at the lower part of the balancer housing 110 due to gravity. When the drum 30 is rotated to spin-dry the laundry in this state, centrifugal force is applied to the masses 141. As a result, the masses 141 move along the channel 110*a* of the balancer housing 110. During movement of the masses 141 along the channel 110*a* of the balancer housing 110, the masses 141 are received and located in the grooves 150. The movement of the masses 141 received and located in the grooves 150 is restrained by magnetic force generated by the magnets 160 before the number of rotations per minute of the drum 30 deviates from a predetermined range. For example, in a case in which the washing machine is designed such that when the number of rotations per minute of the drum 30 is 200 rpm, centrifugal force applied to the masses 141 by rotation of the drum 30, force generated by the masses 141 due to gravity, magnetic force generated by the magnets 160, and force generated by the grooves 150 to support the masses 141 are balanced, the movement of the masses 141 is restrained in a state in which the masses 141 are received and located in the grooves 150 when the number of rotations per minute of the drum 30 is between 0 and 200 rpm at the beginning of spin-drying of laundry. As described above, the movement of the masses 141 is restrained when the drum 30 is rotated at relatively low speed at the beginning of spin-drying of laundry to prevent the masses 141 from generating vibration of the drum 30 together with laundry L or to prevent the increase of vibration generated by the laundry L. In addition, noise due to vibration of the drum 30 may be reduced.

When the number of rotations per minute of the drum 30 deviates from the predetermined range, as shown in FIG. 14, the masses 141 received and restrained in the grooves 150 or the section increase portions 158 are separated from the grooves 150 or the section increase portions 158 and move along the channel 110*a* of the balancer housing 110 to perform a balancing function of the drum 30.

For example, in a case in which the washing machine is designed such that when the number of rotations per minute of the drum 30 is 200 rpm, centrifugal force applied to the masses 141 by rotation of the drum 30, force generated by the masses 141 due to gravity, magnetic force generated by the magnets 160, and force generated by the grooves 150 to support the masses 141 are balanced, the centrifugal force applied to the masses 141 is increased when the number of rotations per minute of the drum 30 exceeds 200 rpm. As a result, the masses 141 are separated from the grooves 150 or the section increase portions 158 and move along the channel 110*a* of the balancer housing 110. At this time, the masses 141 are controlled to slide and roll in a direction to offset unbalanced load Fu generated in the drum 30 due to one-side accumulation of the laundry L, i.e. a direction opposite to the direction in which the unbalanced load Fu is applied to the drum 30. Consequently, forces Fa and Fb to offset the unbalanced load Fu are generated to stabilize rotation of the drum 30.

As is apparent from the above description, the balancer effectively offsets unbalanced load applied to the drum, thereby stabilizing rotation of the drum.

In addition, vibration and noise are prevented from being generated from the drum due to the masses provided to balance the drum before the drum reaches predetermined rotational speed.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A balancer mounted to a drum of a washing machine to offset unbalanced load generated in the drum during rotation of the drum, the balancer comprising:

a balancer housing having an annular channel defined therein;

at least one mass movably disposed in the channel; and at least one magnet coupled to one side of the balancer housing to restrain movement of the at least one mass along the channel when rotational speed of the drum is within a predetermined range, wherein the balancer housing comprises a first housing opened at one side thereof, the first housing comprising a first inner surface corresponding to an inner circumference of the first housing, a second inner surface corresponding to an outer circumference of the first housing, and a third inner surface connected between the first inner surface and the second inner surface, the second inner surface being opposite to the first inner surface, the first inner surface and the second inner surface extending in an axial direction of the drum, and the third inner surface extending in a radial direction of the drum; and a second housing to cover the first housing to define the annular channel, wherein the second inner surface includes an inclined sidewall formed between the second inner surface and the third inner surface configured to support the at least one mass in a direction resisting centrifugal force applied to the at least one mass during rotation of the drum, the inclined sidewall being inclined with respect to the axial direction of the drum, wherein the inclined sidewall includes first sections, each having a first inclination angle and a second section having a second inclination angle disposed circumferentially between the first sections, the first and second inclination angles being formed between the second inner surface and the inclined sidewall and the first inclination angle of the first sections being less than the second inclination angle of the second section, and wherein the inclined sidewall is formed obliquely with a surface of the magnet in contact with the balancer housing.

2. The balancer according to claim 1, wherein the inclined sidewall extends along the second inner surface in a circumferential direction of the balancer housing.

3. The balancer according to claim 1, wherein the second inclination angle of the second section is approximately 5 to 25 degrees with respect to second inner surface.

4. The balancer according to claim 1, wherein the magnet is coupled to an outer surface of the balancer housing and disposed at a position corresponding to the inclined sidewall.

5. The balancer according to claim 4, wherein the magnet comprises a pair of magnets disposed symmetrically on the basis of a virtual line passing through a center of rotation of the drum.

6. The balancer according to claim 1, wherein a damping fluid is contained in the channel.

7. A washing machine comprising:

a cabinet;

a drum rotatably disposed in the cabinet; and a balancer coupled to the drum to offset unbalanced load generated in the drum during rotation of the drum, wherein the balancer comprises a balancer housing having an annular channel defined therein, the balancer housing having a first inner surface corresponding to an inner circumference of the housing and a second inner surface corresponding to an outer circumference of the housing and being opposite to the first inner surface, the balancer housing further comprising a third inner surface connected between the first inner surface and second inner surface;

at least one mass movably disposed in the channel; and a first magnet and a second magnet coupled to one side of the balancer housing to restrain movement of the at least one mass along the channel when rotational speed of the drum is within a predetermined range, an angle between a first perpendicular line perpendicularly connecting the first magnet and a center of rotation of the drum and a second perpendicular line perpendicularly connecting the second magnet and the center of rotation of the drum is between 150 and 210 degrees, wherein an inclined sidewall is formed at a portion of the inner surface, the inclined sidewall being formed between the second inner surface and the third inner surface and configured to support the mass in a direction resisting centrifugal force applied to the mass during rotation of the drum, the inclined sidewall includes first sections, each having a first inclination angle and a second section having a second inclination angle disposed circumferentially between the first sections, the first and second inclination angles being formed between the second inner surface and the inclined sidewall and the first inclination angle of the first sections being less than the second inclination angle of the second section, and the magnet is disposed at a position corresponding to the inclined sidewall, the inclined sidewall extending obliquely from the second inner surface toward the magnet.

8. The washing machine according to claim 7, wherein the first magnet and the second magnet are disposed symmetrically.

9. The washing machine according to claim 7, wherein the first magnet and the second magnet are coupled to a rear surface of the balancer housing.

* * * * *